US006312112B1

(12) United States Patent
Pietrzyk

(10) Patent No.: US 6,312,112 B1
(45) Date of Patent: Nov. 6, 2001

(54) LONG LIFE PRINTHEAD ARCHITECTURE

(75) Inventor: Joe R. Pietrzyk, San Diego, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/351,271

(22) Filed: Jul. 12, 1999

(51) Int. Cl.[7] ..... B41J 2/05
(52) U.S. Cl. ..... 347/65; 347/94
(58) Field of Search ..... 347/65, 87, 94

(56) References Cited

U.S. PATENT DOCUMENTS 5,278,584 * 1/1994 Keefe et al. ..... 347/63
5,648,806 7/1997 Steinfield et al. ..... 347/87
5,666,143 9/1997 Burke et al. ..... 347/65
5,699,093 12/1997 Alderson ..... 347/54
5,734,399 3/1998 Weber et al. ..... 347/65
6,053,599 * 4/2000 Maeda ..... 347/65

* cited by examiner

*Primary Examiner*—Huan Tran
*Assistant Examiner*—Blaise Mouttet

(57) ABSTRACT

The present invention provides an ink feed architecture for an inkjet printhead that extends the life of firing resistors. Two separate ink channels lead to each firing chamber. The ink channels are asymmetric with respect to the firing chamber, causing an asymmetric flow pattern that pushes the collapsing drive bubble and distributes the associated high pressure spikes over the resistor surface. This increases the life of the resistors.

20 Claims, 4 Drawing Sheets

LONG LIFE PRINTHEAD ARCHITECTURE

FIELD OF THE INVENTION

The present invention is generally related to a printhead for an inkjet printer and, more particularly, to the design of ink feed channels for the ink firing chambers within the printhead.

BACKGROUND

Thermal inkjet printers operate by expelling a small volume of ink through a plurality of small nozzles in a printhead held in proximity to a medium to be printed upon. The expulsion of droplets of ink from the nozzles relative to a particular position on the medium results in the production of a portion of a desired character or image. Controlled repositioning of the printhead or the medium and another expulsion of ink droplets continues the production of more pixels of the desired character or image. Inks of selected colors may be coupled to individual arrangements of nozzles to produce a multicolored image by the inkjet printer.

Expulsion of an ink droplet in a conventional thermal inkjet printer is a result of rapid thermal heating of the ink to a temperature which exceeds the boiling point of the ink solvent and creates a gas phase bubble of ink. Each nozzle is coupled to a small unique ink firing chamber filled with ink and having an individually addressable heater resistor thermally coupled to the ink. As the bubble nucleates and expands, it displaces a volume of ink which is forced out of the nozzle and deposited on the medium. After deactivation of the heater resistor, the bubble then collapses, and the displaced volume of ink is replenished, by capillary action, from a larger ink reservoir through ink feed channels.

The life of the heater or firing resistors in the thermal inkjet printhead is often limited by cavitation damage caused by the rapidly collapsing drive bubble. In the past, a thick layer of tantalum was used to protect the resistor from the high pressure spikes generated by the collapsing drive bubble. As the tantalum layer thickness increases, more protection is provided so the resistor life generally increases. The disadvantage of this tantalum layer is that it causes an increase in the amount of energy required to eject a drop because the tantalum layer effectively insulates the resistor surface. This increase in firing energy causes the pen to run hotter, which affects print quality and other aspects of reliability.

It is desirable, therefore, to develop a printhead design that increases the life of a firing resistor in a thermal inkjet printhead without incurring the disadvantages of the prior art.

SUMMARY

The present invention provides an ink feed architecture for a printhead that extends the life of firing resistors. The disclosed ink feed channel architecture results in the bubble collapse force being more evenly distributed across the face of the resistor, as compared to prior art designs. Based on tests conducted, the present design doubles the resistor life to over one billion drops per resistor. The increase in resistor life is thought to be caused by the flow pattern in the firing chamber during refill.

Two separate ink channels lead to the firing chamber. The ink channels are asymmetric with respect to the firing chamber, causing an asymmetric flow pattern that pushes the collapsing drive bubble and distributes the associated high pressure spikes over the resistor surface.

The particular design is well suited for very high resolution (e.g., 600 dots per inch) printheads since the two ink channels for a particular firing chamber add very little area to a conventional design.

In one embodiment, the barrier layer which forms the firing chambers and ink channels extends close to the resistor edges to force the bubble to expand in an upward (rather than an outward) direction, which more evenly distributes the force of the bubble across the resistor.

DETAILED DESCRIPTION OF THE EMBODIMENTS

The present invention primarily relates to the ink channel and firing chamber design for an inkjet printhead. However, to place the printhead architecture in context, the printhead structure and one type of ink delivering system will be described with respect to FIGS. 1–3. Additional detail regarding print cartridge designs and the flow of ink from an ink source, around the outer edges of a substrate, and into the ink channels may be found in U.S. Pat. No. 5,648,806, entitled "Stable Substrate Structure for a Wide Swath Nozzle Array in a High Resolution Inkjet Printer," by Steven Steinfield et al., assigned to the present assignee and incorporated herein by reference.

Figure 1:
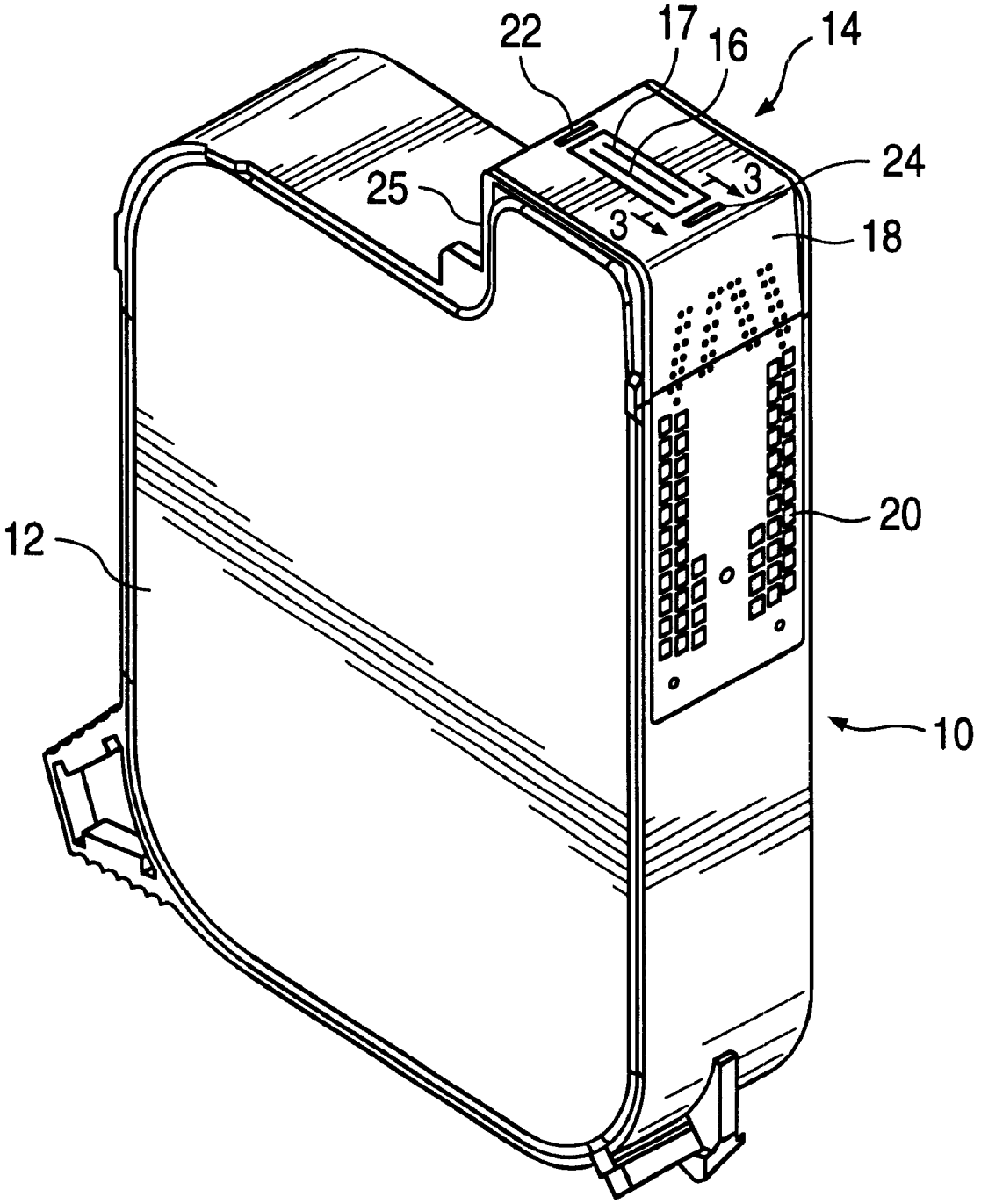
FIG. 1 illustrates a conventional print cartridge body, which houses the printhead of the present invention.

Referring to FIG. 1, reference numeral 10 generally indicates an inkjet print cartridge incorporating a printhead according to one embodiment of the present invention, simplified for illustrative purposes. The inkjet print cartridge 10 includes an ink reservoir 12 and a printhead 14, where the printhead 14 is formed using Tape Automated Bonding (TAB). The printhead 14 (hereinafter "TAB head assembly 14") includes a nozzle member 16 comprising two parallel columns of offset nozzles 17 formed in a polymer flexible tape 18 by, for example, laser ablation.

In another embodiment, the printhead 14 is separate from the ink supply. The ink supply may be located in a fixed location in the printer and connected to the printhead 14 by a flexible tube.

Figure 2:
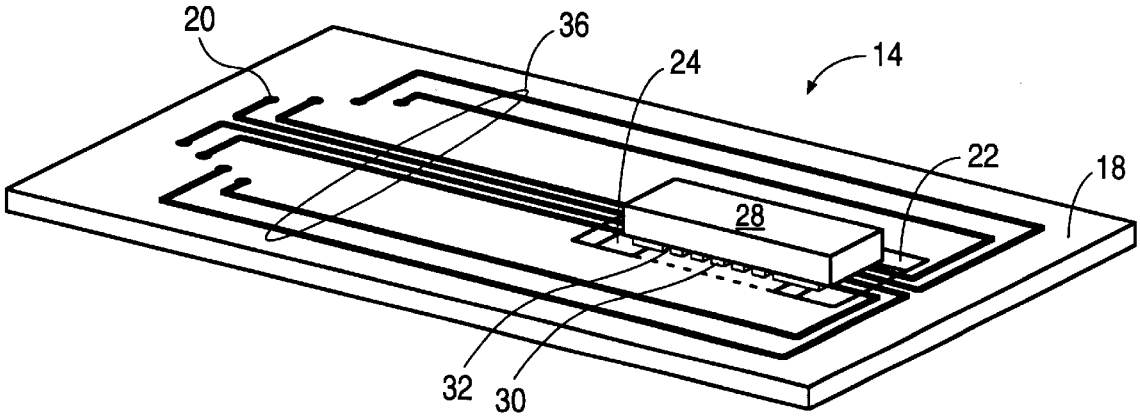
FIG. 2 is a perspective view of the back surface of a Tape Automated Bonding (TAB) printhead assembly, which is secured to the body of the print cartridge of FIG. 1.
Figure 4:
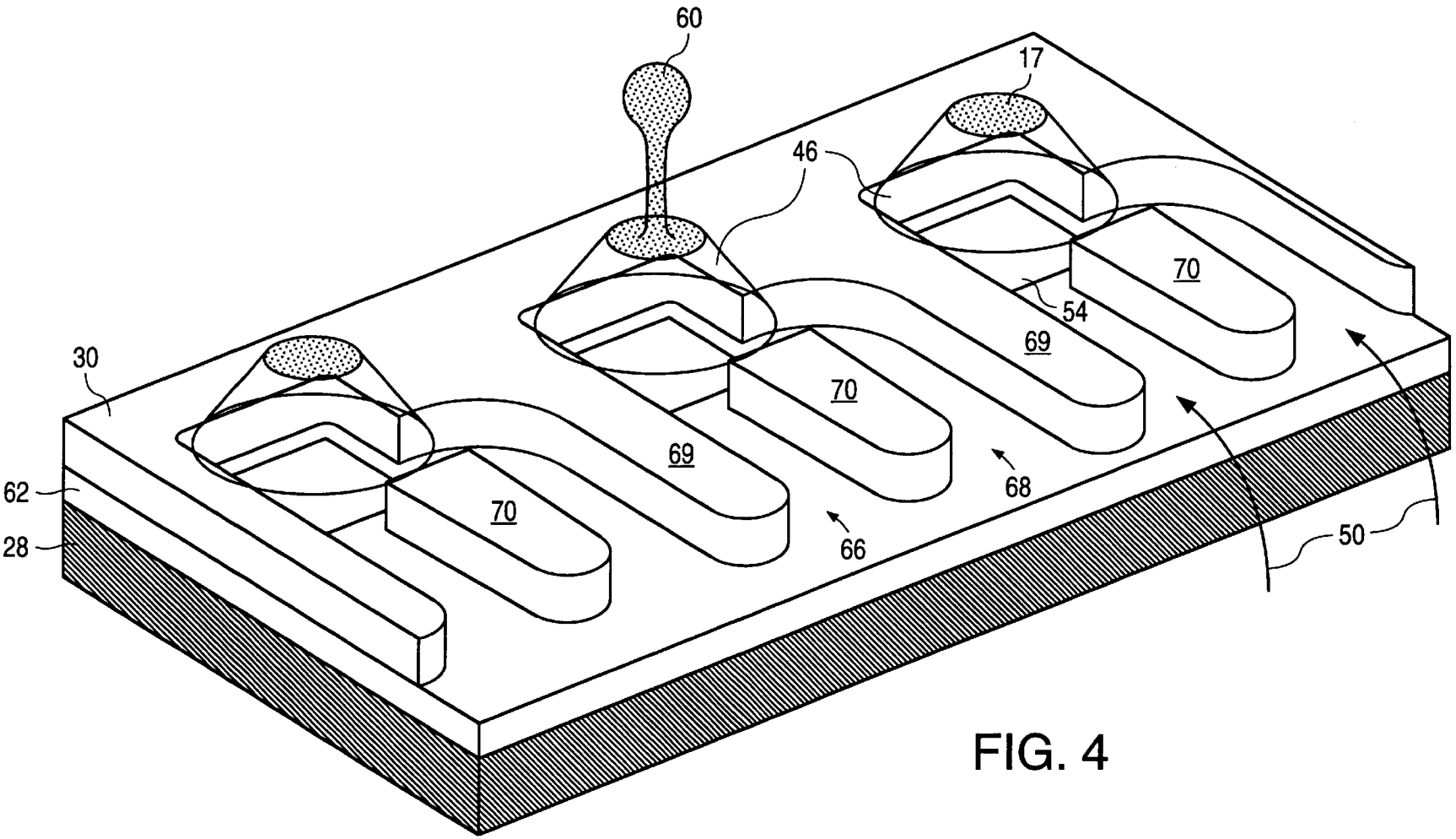
FIG. 4 is a perspective view of a portion of the printhead substrate.
Figure 5:
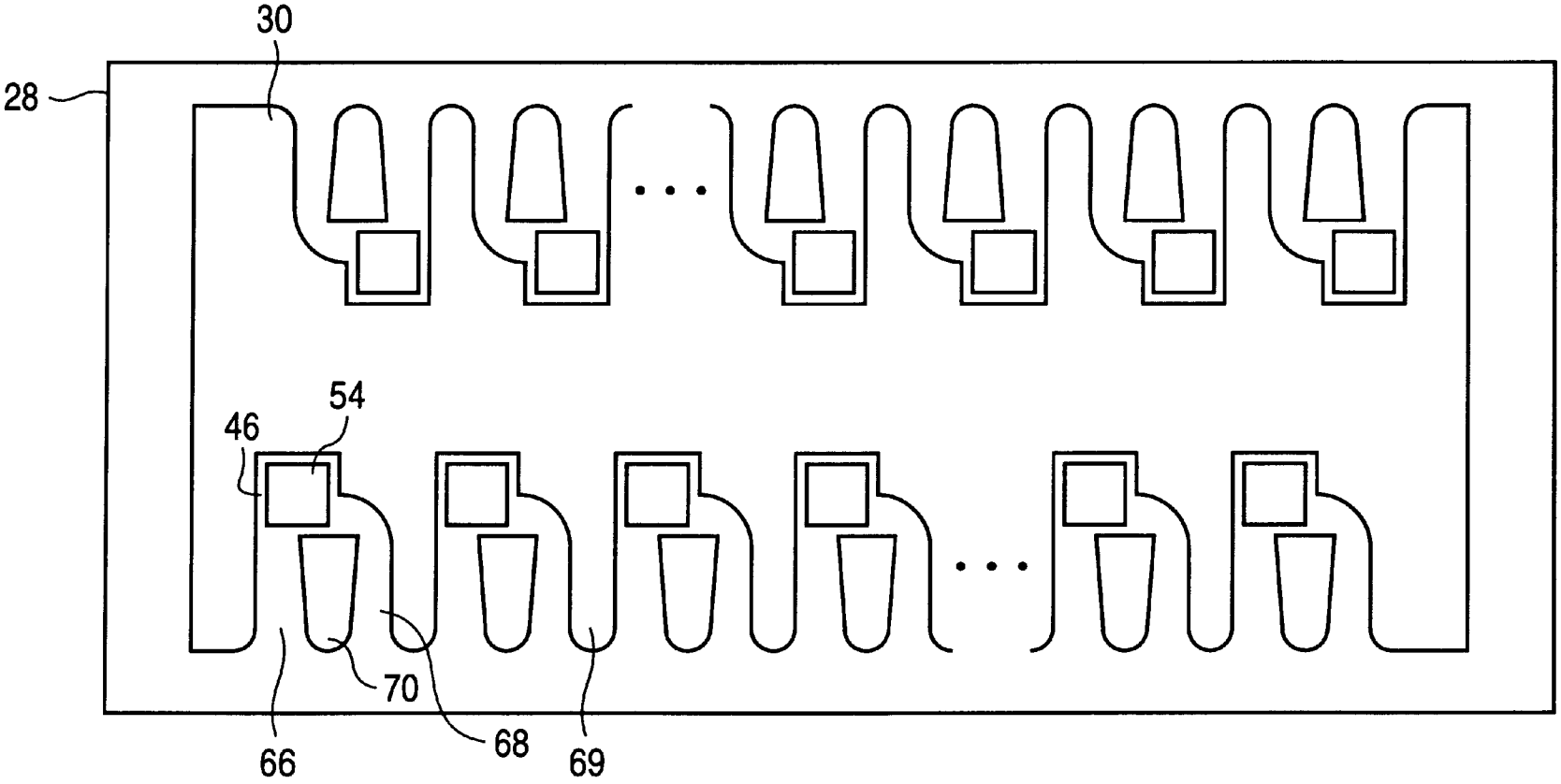
FIG. 5 is a top-down view of the printhead substrate.

FIG. 2 shows the back surface of the TAB head assembly 14 showing the silicon die or substrate 28 mounted to the back of the flexible tape 18 and also showing one edge of the barrier layer 30 formed on the substrate 28 containing ink channels and firing chambers. FIGS. 4 and 5 show greater detail of this barrier layer 30 and will be discussed later. Shown along the edge of the barrier layer 30 are the entrances to the ink channels 32 which receive ink from the ink reservoir 12.

Conductive traces 36 formed on the back of the flexible tape 18 terminate in contact pads 20 (better shown in FIG. 1) exposed on the opposite side of the flexible tape 18. The conductive traces 36 lead to circuitry (not shown) on substrate 28 for firing the individual heater resistors. Such circuitry is described in U.S. Pat. No. 5,648,806. The print cartridge 10 is designed to be installed in a printer so that contact pads 20, on the front surface of the flexible tape 18, contact printer electrodes providing externally generated energization signals to the printhead.

Windows 22 and 24 extend through the flexible tape 18 and are used to facilitate bonding of the ends of the conductive traces 36 to electrodes on the silicon substrate 28. The windows 22 and 24 are filled with an encapsulant to protect any underlying portion of the traces and substrate.

Figure 3:
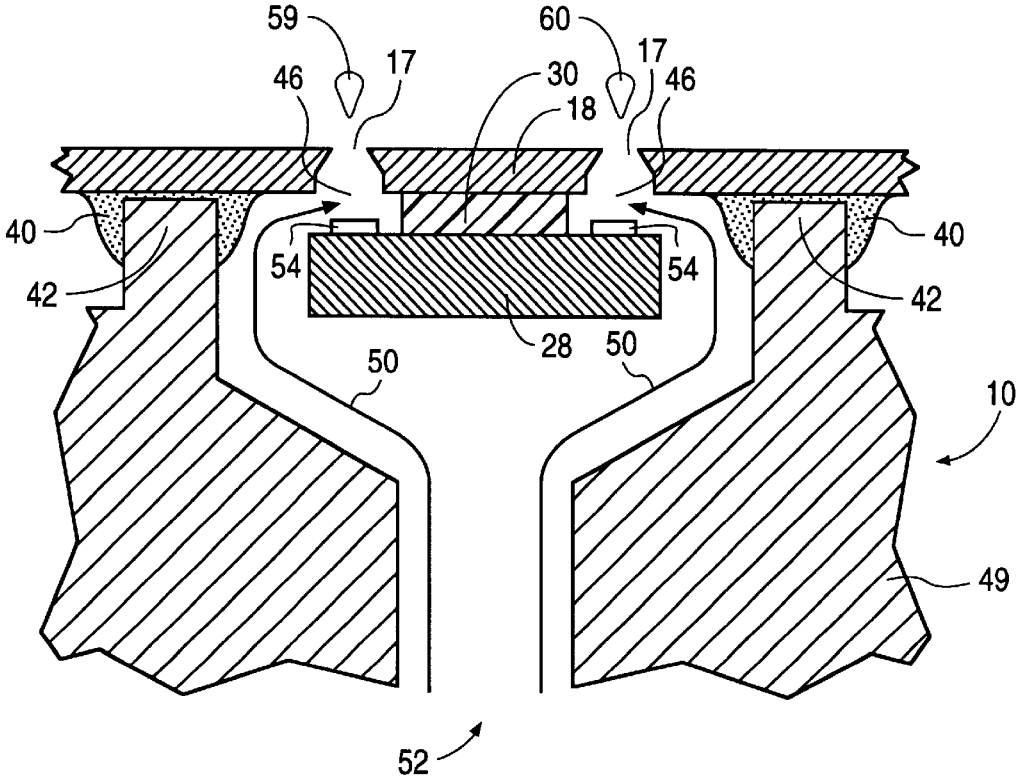
FIG. 3 is a cross-sectional view of the print cartridge taken along line 3—3 in FIG. 1.

Shown in FIG. 3 is a cross-sectional view taken along line 3—3 in FIG. 1 showing a portion of an adhesive seal 40 applied to a wall 42 surrounding the substrate 28 and showing the substrate 28 being adhesively secured to a central portion of the flexible tape 18 by the barrier layer 30. The barrier layer 30 is shown defining the ink channels leading to firing chambers 46. A portion of the plastic body 49 of the print cartridge 10 is also shown.

FIG. 3 also illustrates how ink 50 from the ink reservoir 12 flows through a central opening 52 formed in the print cartridge body 49, around the outer edges of the substrate 28, through ink channels, into the firing chambers 46. Thin film resistors 54 are shown within the firing chambers 46. When a resistor 54 is energized, a portion of the ink within its firing chamber 46 is ejected, as illustrated by the emitted drops of ink 59 and 60.

FIG. 4 is a perspective view of a small portion of substrate 28 having formed on it thin film layers 62. One of the thin film layers forms resistors 54, comprising TaAl. The thin film layers 62 include insulation layers for electrically insulating the conductive and resistive layers from substrate 28 and for insulating and protecting the various layers from the ink. Forming resistors and conductors on a substrate are well known and need not be described herein in detail. The conductive layer, after etching, provides electrical connections between the resistors and substrate electrodes.

After the thin film layers 62 are formed, a photoimagable layer is deposited and formed, using conventional photolithographic techniques, to create barrier layer 30. Barrier layer 30 may be any suitable material including Vacrel™, a photoimagable epoxy, or IJ5000™, available from DuPont. In one embodiment, barrier layer 30 is on the order of 19 $\mu$m thick (around ¾ mils).

In the embodiment shown in FIG. 4, the barrier layer 30 is formed to provide two ink channels 66 and 68 per chamber 46. Ink channels 66 and 68 are asymmetrical. The particular shapes of the ink channels 66 and 68 and chamber 46 result in an asymmetrical ink flow pattern into the chamber 46 as the drive bubble collapses. This asymmetrical flow pattern pushes the collapsing drive bubble to more evenly distribute the associated high pressure spikes across the resistor 54 surface.

An additional benefit of the ink channel design is that, if one ink channel becomes blocked with a particle, the other ink channel may still refill the chamber 46.

This design fits on a short shelf (e.g., 55 $\mu$m for a 600 dpi, 34 mg drop design), where the shelf is the substrate area between the ink channel openings and the edge of the substrate. Short shelf designs provide faster refill and lower meniscus overshoot than longer shelf designs.

Barrier peninsulas 69, separating adjacent firing chambers 46, extend out sufficiently close to the substrate 28 edge to prevent hydraulic cross-talk between adjacent nozzles 17. A barrier island 70 for each firing chamber 46, separating the ink channels 66 and 68, acts as a wall of the firing chamber 46 to force the expanding bubble upward toward a nozzle 17. The barrier island 70 is offset, and thus asymmetrical, with respect to the resistor 54.

Unlike previous designs using dual ink channels that essentially deliver ink to the sides of the resistor, the present design includes one channel 66 which delivers ink across the front of the resistor. This not only enhances the asymmetrical flow to increase the life of the resistor but also results in a more dense arrangement of resistors. This enables a 600 dpi, and higher resolution, printhead.

The barrier layer 30 portion forming the chambers 46, in one embodiment, is positioned relatively close (e.g., 5 $\mu$m) to the resistor edges and provides substantially parallel walls with respect to the resistor edges. This highly confined chamber 46 forces the bubble to move upward, rather than outward, to increase the efficiency of the printhead as well as improve the refill speed.

FIG. 4 omits the flexible tape 18 for simplicity but illustrates the positions of nozzles 17. An ink drop 60 is shown being ejected from one of the nozzles 17.

FIG. 5 is a top-down view of the printhead of FIG. 4 with the size of the ink channels, chambers, and resistors greatly enlarged with respect to the substrate size. A single substrate 28 may be ½ inch long to 1 inch long or greater. FIG. 5 illustrates the offsetting of the two linear rows of resistors 54 so as to provide high resolution along the length of the substrate.

In one embodiment, each resistor 54 is approximately 35 $\mu$m square; the shelf length, measured from the substrate edge to the resistor center, is nominally 73 $\mu$m; the barrier layer 30 thickness is nominally ¾ mil; each ink channel is approximately 19 $\mu$m wide, with the minimum channel width located as far from the substrate edge as possible to reduce sensitivity to dimple; the barrier islands 70 extend out to within 10 $\mu$m of the substrate edge; each chamber 46 has side wall gaps of approximately 5 $\mu$m; the flexible tape 18 thickness is approximately 2 mils; and the nozzle exit diameter is approximately 28 $\mu$m, with a straight tapered bore of nominally 12 degrees.

As shown in FIG. 3, the flexible tape 18, having nozzles 17 formed therein, is affixed to the barrier layer 30, and the resulting structure is placed on the print cartridge body and sealed using adhesive 40 to allow ink to flow from the ink reservoir 12, around the side edges of the substrate 28, and into the ink channels 66 and 68.

The particular dimensions of the barrier layer 30 features are optimized for a firing frequency of around 12–15 kHz.

The ink feed architecture may also be used with other than thermal ink ejection elements to extend the life of such elements. The substrate may be any type of structure. The ink reservoirs may be located within a print cartridge or may be detachable from the printhead. The ink reservoirs may also be stationary and connected to the printhead by a flexible tube, such as described in U.S. Pat. No. 5,675,367, assigned to the present assignee and incorporated herein by reference.

The insertion of the resulting print cartridge of FIG. 1 into a carriage in a printer and the operation of such a printer is described in U.S. Pat. No. 5,648,806, incorporated herein by reference, and need not be repeated. The print cartridge may be used in conventional single pass and multi-pass printers, where the paper is shifted by rollers after one or more passes of the scanning printhead.

The present invention is equally applicable to alternative printing systems (not shown) that utilize alternative media and/or printhead moving mechanisms, such as those incorporating grit wheel, roll feed, or drum or vacuum belt technology to support and move the print media relative to the printhead assemblies. With a grit wheel design, a grit wheel and pinch roller move the media back and forth along one axis while a carriage carrying one or more printhead assemblies scans past the media along an orthogonal axis. With a drum printer design, the media is mounted to a rotating drum that is rotated along one axis while a carriage carrying one or more printhead assemblies scans past the media along an orthogonal axis. In either the drum or grit wheel designs, the scanning is typically not done in a back and forth manner.

Multiple printheads may be formed on a single substrate. Further, an array of printheads may extend across the entire width of a page so that no scanning of the printheads is needed; only the paper is shifted perpendicular to the array.

While particular embodiments of the present invention have been shown and described, it will be obvious to those skilled in the art that changes and modifications may be made without departing from this invention in its broader aspects and, therefore, the appended claims are to encompass within their scope all such changes and modifications as fall within the true spirit and scope of this invention.

What is claimed is:

1. A printing system comprising:

a printhead, said printhead comprising:

a substrate;

a plurality of ink ejection elements formed on said substrate, each of said ink ejection elements having a front edge and a first side edge adjacent to said front edge;

a plurality of firing chambers, each firing chamber substantially surrounding an associated ink ejection element;

two ink channels leading to each firing chamber, said ink channels receiving ink from an ink reservoir, said two ink channels being asymmetrical with respect to an associated ink ejection element to create an asymmetrical ink flow into said firing chamber, a first of said ink channels having a substantially straight path and delivering a majority of ink flowing therein to said associated firing chamber over said front edge of said ink ejection element, a second of said ink channels delivering a majority of ink flowing therein to said associated firing chamber over said first side edge; and a barrier island separating each of said two ink channels, said barrier island being asymmetrical with respect to said associated ink ejection element, wherein said second ink channel is substantially parallel to said first ink channel until said second ink channel has extended beyond said barrier island, said second ink channel then curving toward said first side edge of said associated ink ejection element.

2. The system of claim 1 wherein each of said ink ejection elements has a back edge, opposite said front edge, and a second side edge, opposite said first side edge, and wherein each firing chamber comprises a first wall along said second side edge which is a continuation of a wall of said first ink channel, said firing chamber having a back wall perpendicular to said first wall running along said back edge of said ink ejection element, and a third wall parallel to said first wall and perpendicular to said back wall.

3. The system of claim 2 wherein said firing chamber has a fourth wall forming an edge of said barrier island, said fourth wall being along said front edge of said ink ejection element and perpendicular to both said first wall and said third wall.

4. The system of claim 3 wherein said barrier island is offset with respect to said ink ejection element so that an edge of said barrier island extends beyond said first side edge of said ink ejection element.

5. The system of claim 1 wherein each firing chamber has walls, said walls positioned approximately 5 $\mu$m from edges of said ink ejection elements and substantially parallel to said edges.

6. The system of claim 1 wherein said first ink channel has a width approximately the same width as said second ink channel.

7. The system of claim 6 wherein said width of said first ink channel and said second ink channel is approximately 19 $\mu$m wide.

8. The system of claim 1 wherein said substrate has at least one outer edge, and wherein entrances to said two ink channels are proximate to said outer edge to allow ink to flow from the ink reservoir, around said outer edge, and into said two ink channels.

9. The system of claim 8 wherein said substrate includes a first outer edge and a second outer edge, and wherein said plurality of ink ejection elements, said plurality of firing chambers, said two ink channels for each firing chamber, and said barrier island separating said two ink channels are arranged along two opposite outer edges of said substrate to allow ink to flow from the ink reservoir, over said two outer edges of said substrate, and into ink channels arranged along said outer edges.

10. The system of claim 1 further comprising:

electrodes on said substrate providing an electrical connection to said plurality of ink ejection elements; and a flexible tape having conductors formed thereon, said conductors having ends electrically connected to said electrodes on said substrate.

11. The system of claim 10 further comprising a print cartridge body, said flexible tape being affixed to said print cartridge body, said substrate being fluidically sealed with respect to said print cartridge body to allow ink to flow from the ink reservoir and into said ink channels.

12. The system of claim 1 further comprising said ink reservoir and a print cartridge body supporting said printhead in a printer, wherein said ink reservoir is located in said print cartridge body.

13. The system of claim 1 further comprising said ink reservoir and a print cartridge body supporting said printhead in a printer, wherein said ink reservoir is external to said print cartridge body.

14. The system of claim 1 further comprising said ink reservoir and a print cartridge body supporting said printhead in a printer, wherein said ink reservoir is connected to said print cartridge body with a flexible tube.

15. The system of claim 1 further comprising an inkjet printer, said printhead being installed in said inkjet printer for printing on a medium.

16. The system of claim 1 further comprising ink provided to said ink channels.

17. The system of claim 1 wherein said ink ejection elements are resistors.

18. A method for printing comprising:

flowing ink from an ink reservoir around at least one outer edge of a printhead substrate; and directing said ink that flowed around said outer edge of said substrate into a plurality of firing chambers, each firing chamber containing an ink ejection element, each firing chamber having two ink channels through which ink flows into said firing chamber, said two ink channels comprising a first ink channel and a second ink channel, said first and second ink channels being separated by a barrier island, said first ink channel having a substantially straight path, said second ink channel being substantially parallel to said first ink channel until said second ink channel has extended beyond said barrier island, said second ink channel then curving toward said associated ink ejection element, a majority of the ink flowing through said first ink channel flowing to said firing chamber and across a front edge of an associated ink ejection element, a majority of the ink flowing through said second ink channel flowing to a side of said firing chamber across a side edge of said ink ejection element so as to create an asymmetrical ink flow into said firing chamber.

19. The method of claim 18 further comprising providing electrical signals to said ink ejection elements to eject droplets of ink from associated nozzles, causing ink to refill said firing chambers through said two ink channels.

20. A printing system comprising:

a printhead comprising:

a substrate;

a plurality of ink ejection elements formed on said substrate, each of said ink ejection elements having a front edge and a first side edge adjacent to said front edge;

a plurality of firing chambers, each firing chamber substantially surrounding an associated ink ejection element;

two ink channels leading to each firing chamber, said ink channels receiving ink from an ink reservoir, a first of said ink channels having a substantially straight path and delivering a majority of ink flowing therein to said associated firing chamber over said front edge of said ink ejection element, a second of said ink channels delivering a majority of ink flowing therein to said associated firing chamber over said first side edge of said ink ejection element, a width of the first ink channel being approximately equal to a width of the second ink channel; and a barrier island separating each of said two ink channels, said barrier island being asymmetrical with respect to said associated ink ejection element, wherein said second ink channel is substantially parallel to said first ink channel until said second ink channel has extended beyond said barrier island, said second ink channel then curving toward said first side edge of said associated ink ejection element.

* * * * *